US005565903A

United States Patent [19]

Ueda

[11] Patent Number: 5,565,903

[45] Date of Patent: Oct. 15, 1996

[54] LAMP TEMPERATURE CONTROL DEVICE SUITABLE FOR COLOR DIRECT THERMAL PRINTER

[75] Inventor: Satoshi Ueda, Saitama, Japan

[73] Assignee: Fuji Photo Film Co., Ltd., Kanagawa, Japan

[21] Appl. No.: 542,899

[22] Filed: Oct. 13, 1995

[30] Foreign Application Priority Data

Oct. 18, 1994 [JP] Japan ..... 6-251847

[51] Int. Cl.[6] ..... B41J 2/315; B41J 2/32

[52] U.S. Cl. ..... 347/175; 362/294

[58] Field of Search ..... 362/255, 294, 362/373, 345, 802, 276, 296, 96; 355/208, 285, 288; 361/694, 695, 690, 688, 689; 347/175; 400/120.03

[56] References Cited

U.S. PATENT DOCUMENTS 4,835,667 5/1989 Wolfe ..... 362/802

FOREIGN PATENT DOCUMENTS 0409757 1/1991 European Pat. Off. ..... 362/294
0443784 8/1991 European Pat. Off. ..... 362/294
3923108 2/1990 Germany ..... 362/294
63-33321 9/1988 Japan .
4-308788 10/1992 Japan .
6-215615 8/1994 Japan ..... 362/294

*Primary Examiner*—Huan H. Tran
*Attorney, Agent, or Firm*—Sughrue, Mion, Zinn, Macpeak & Seas

[57] ABSTRACT

A color direct thermal printer has a yellow fixing ultraviolet lamp and a magenta fixing lamp, each having a longitudinal axis. Behind the yellow fixing lamp is disposed a reflector which has portions contacting the yellow fixing lamp in the longitudinal direction for receiving heat from the yellow fixing lamp. The yellow fixing lamp and the reflector is contained in a cylindrical housing of a channel shape with cooling fans which are respectively mounted on opposite ends of the housing. Outside the reflector, a pair of temperature sensors are mounted to be close to the respective fans, and each measure tube temperature of the yellow fixing lamp at right and left sides indirectly through the reflector. If measured temperature greater than 40° C. is measured by at least one of the sensors, corresponding at least one of the fans is driven to send air to the yellow fixing lamp. The magenta fixing lamp is arranged in a same manner as the yellow fixing lamp. When the measured temperature becomes less than or equal to 40° C., the driving of the fan is stopped. Further, if the measured temperature is less than 30° C. at the time of operating a starting key, at least one of the lamps is caused to pre-emit light to raise the tube temperature.

15 Claims, 4 Drawing Sheets

LAMP TEMPERATURE CONTROL DEVICE SUITABLE FOR COLOR DIRECT THERMAL PRINTER

BACKGROUND OF THE INVENTION

1. Field of the Invention

The present invention relates to a lamp temperature control device, and a color direct thermal printer having the control device. More particularly, the present invention relates to a lamp temperature control device capable of maintaining intensity of radiation of the tubular lamp while adjusting tube temperature of the tubular lamp.

2. Description Related to the Prior Art

There are various machines including tubular light source such as a fluorescent lamp or an ultraviolet lamp. In a color direct thermal printer, an ultraviolet lamp in a tubular shape is used to emanate ultraviolet radiation for fixing one of primary color images recorded on color thermosensitive recording material. The color thermosensitive recording material is constituted of base sheet, a cyan coloring layer, a magenta coloring layer, and a yellow coloring layer. The thermal recording is performed in the order from an uppermost layer at the obverse to the undermost layer. The coloring of a layer, of which the recording is finished, is fixed by application of ultraviolet radiation in a wavelength range appropriate for each layer, before the next underlying layer is subjected to the recording. This is for the purpose of invalidating the coloring ability and preventing the colored layer from being colored by next heating. Since the ultraviolet lamp emanates radiation not only to the front but also to the rear, a reflector is disposed behind the lamp.

The ultraviolet lamp, as disclosed in JP-Y 63-33321, has a radiating intensity which is changeable according to the temperature of a lamp tube. The lamp has such characteristics that, if the tube temperature is lower, then the radiating intensity is lower; if the tube temperature rises, then the radiating intensity is raised; and when the tube temperature is extremely high, then the radiating intensity decreases. In view of stabilizing the fixation of the coloring, it is necessary to keep constant the ultraviolet radiating intensity, without being influenced by changes in the tube temperature of the lamp.

In the conventional thermal printer according to the color direct recording, there is provided a sensor for detecting temperature and a lamp cooling fan, in order to control the radiating intensity of the lamp, so that the tube temperature of the lamp is kept from being high. The fan is disposed in association with the one end of the lamp and applies with cooling air from the one end toward the other end. The lamp is somewhat long in order to direct a center portion of the lamp to a recording area of the recording material, since the center portion of the lamp has large and stable radiating intensity.

However, it is difficult to apply such long lamp overall with the cooling air from the one end to the other end of the lamp, so that the long lamp has different tube temperature between a position near the fan and a position apart from the fan. That causes the color recording material to be supplied with uneven intensity ultraviolet radiation depending on the directed portion of the long lamp, and unstable color fixation to be occurred.

SUMMARY OF THE INVENTION

In view of the foregoing problems, an object of the present invention is to provide a lamp temperature control device which can keep the tube temperature of the lamp constant wholly.

Another object of the present invention is to provide a color direct thermal printer capable of performing stable fixing.

In order to achieve the above and other objects and advantages of this invention, a reflector is disposed in such a manner that a center portion of a lamp having longitudinal axis is covered with the reflector, and a pair of cooling fans are arranged face to face with opposite ends of the long lamp so as to cool the long lamp from both sides in the axial direction of the long lamp. A pair of temperature sensors are mounted on both sides of the reflector for detecting indirectly the tube temperature. In accordance with the measured temperature by the sensors, the fans are controlled to be driven.

In a preferred embodiment, the long lamp and the reflector are contained in a housing of a channel-shape, and the fans are faced to the ends of the long lamp, respectively. The sensors are disposed to be closed to the fans, respectively. The reflector is in contact with the long lamp along the longitudinal direction so that the sensors measure indirectly the tube temperature of the long lamp at the right and left sides. Before the long lamp is turned on, the tube temperature is measured. When a measured temperature is greater than a first temperature, the corresponding fan is driven. When the measured temperature decreases and becomes less than or equal to the first temperature, the corresponding fan is stopped from operation. When a temperature which is less than a second temperature lower than the first temperature is detected by at least one of the sensors, then the long lamp pre-emits light to heat the tube thereof so as to raise the tube temperature. Further, the tube temperature is measured while the long lamp is turned on, and the fans are still controlled according to the measured temperature. The fans are controlled in their rotational speed according to the measured temperature.

In the present invention, the fans are arranged face to face with the ends of the long lamp, so as to apply air to the long lamp overall. The tube temperature of the long lamp is measured at right and left sides and the fans are driven and stopped according to the measured temperature. Accordingly, the long lamp may be cooled wholly and evenly so as to eliminate the temperature gradient in the longitudinal direction of the long lamp. On the other hand, the long lamp may be cooled by rotating the fans with speed according to the temperature gradient based on the measured temperature so that the tube temperature is efficiently uniformed and kept constant. Further, the channel-shaped housing provided between the fans may be helpful for stably streaming cooling air along the long lamp. Therefore, it is possible to cool the long lamp promptly when the measured temperature is greater than the first temperature.

The lamp temperature control device is applicable to a color direct thermal printer having two tubular ultraviolet lamps. Tube temperature of the ultraviolet lamps is adjusted so as to obtain stable and constant ultraviolet radiation. Accordingly, the stably color fixing can be executed.

BRIEF DESCRIPTION OF THE DRAWINGS

The above objects and advantages of the present invention will become more apparent from the following detailed description when read in connection with accompanying drawings, in which.

DETAILED DESCRIPTION OF THE PREFERRED EMBODIMENTS OF THE PRESENT INVENTION

Figure 1:
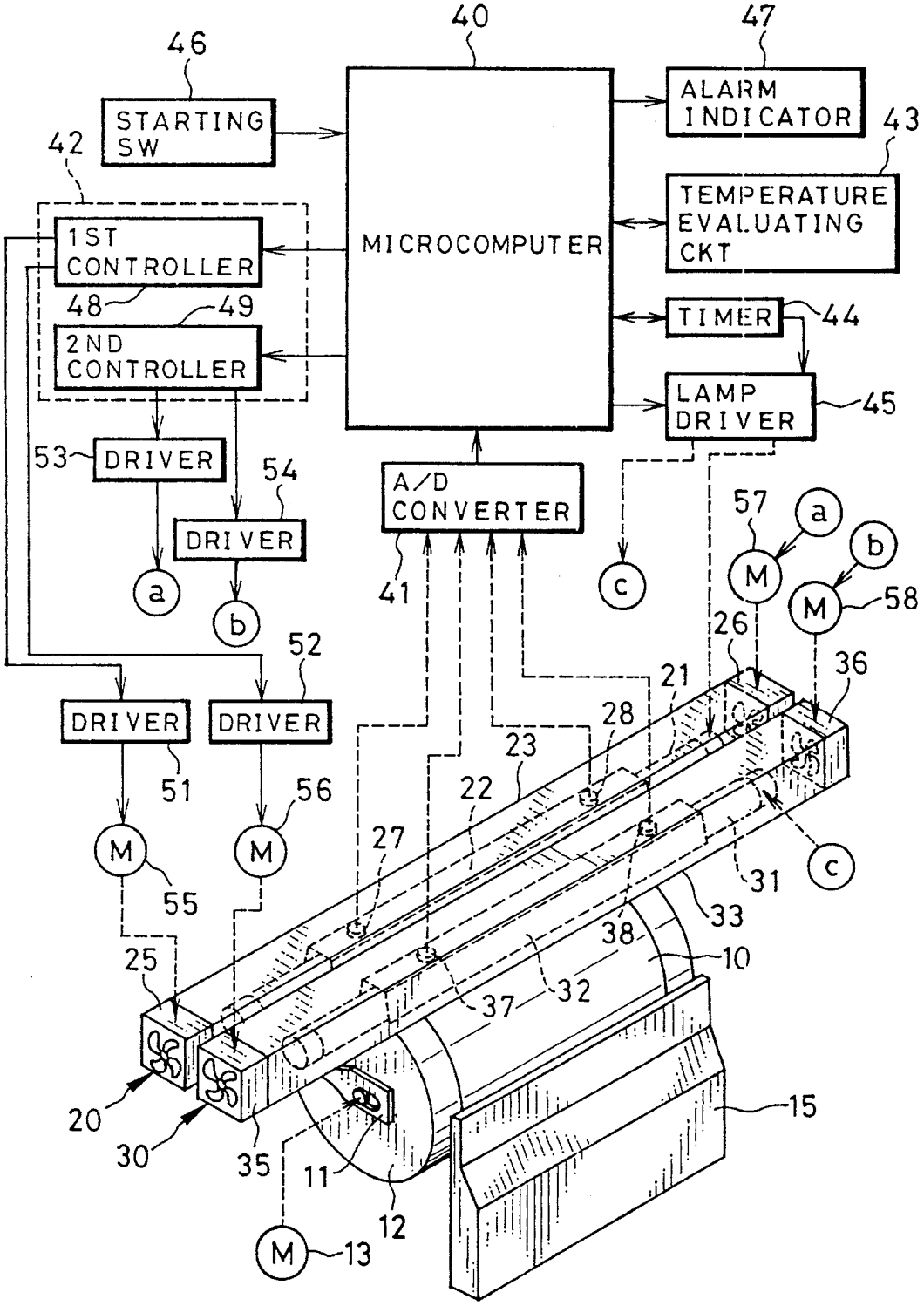
FIG. 1 is a schematic view illustrating a color direct thermal printer incorporating a lamp temperature control device provided with lamp units in accordance with an embodiment of the present invention.

In FIG. 1 illustrating a printer according to the color direct thermal printing for an embodiment of the present invention, a color thermosensitive recording material 10 of a sheet shape is fixedly mounted on a platen drum 12 while a leading end of the recording material 10 is retained by a clamp member 11. During a printing operation inclusive of thermal recording and fixation, the platen drum 12 is rotated at a stable speed by a platen motor 13.

Near the periphery of the platen drum 12 are arranged a thermal head 15 and lamp units 20 and 30. The thermal head 15 is in a position for thermal recording. The lamp units 20 and 30 lie downstream from the thermal head 15. The thermal head 15 is constituted of a great number of linearly arranged heating elements, and emits heat energy adapted to a characteristic of each color and coloring density.

Figure 2:
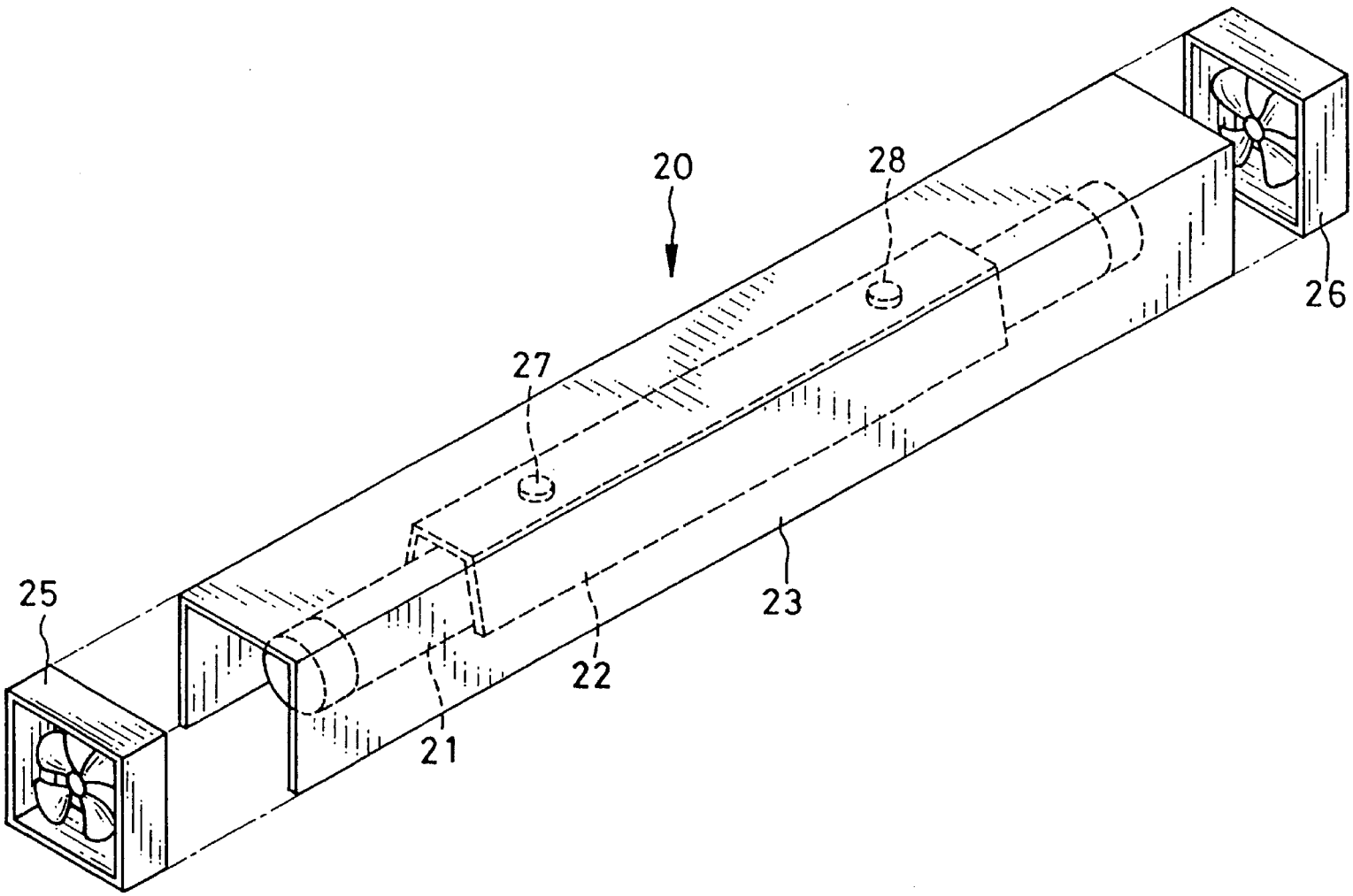
FIG. 2 is a schematic view illustrating one of the lamp units.
Figure 3:
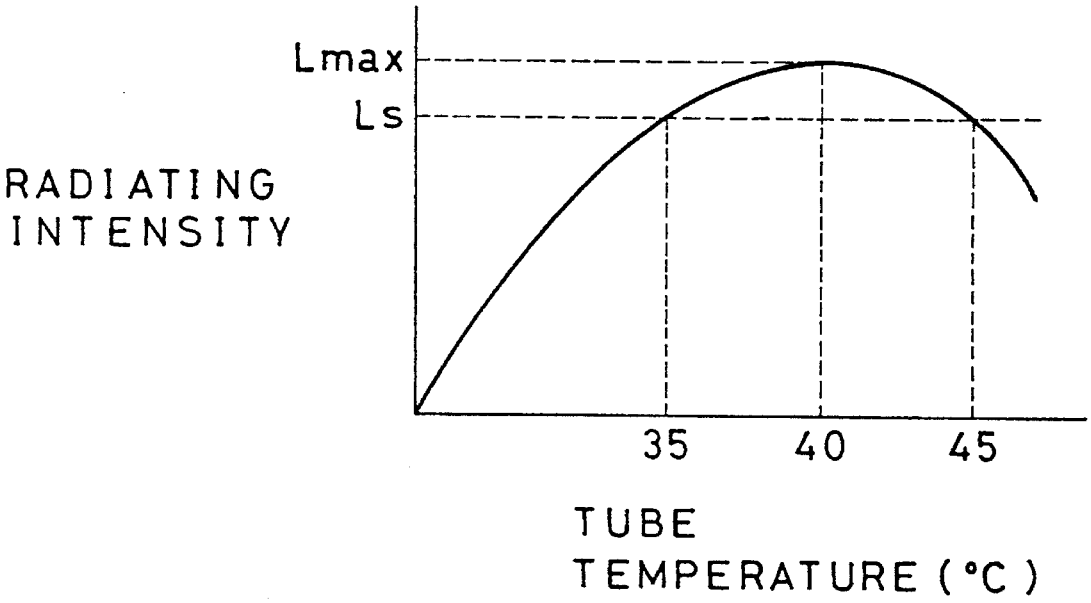
FIG. 3 is a graph illustrating a relationship between tube temperature of an ultraviolet lamp and radiating intensity thereof.

The lamp unit 20 is constituted of a yellow color fixing ultraviolet lamp 21 having a longitudinal axis, which is driven by application with A.C. voltage, a reflector 22 disposed behind the long lamp 21, a channel-shaped housing 23 and a pair of cooling fans 25 and 26, as illustrated in FIG. 2. The fans 25 and 26 are mounted on the opposite ends of the housing 23 for sending air to the long lamp 21 in the axial direction. The long lamp 21 emanates ultraviolet radiation peaking at a wavelength of approximately 420 nm in the radiating distribution. As illustrated in FIG. 3, the radiation intensity of the long lamp 21 comes up to the maximum Lmax when the tube temperature is 40° C., and comes to a standard radiating intensity Ls required for fixation when the tube temperature is 35° C. or 45° C. The long lamp 21 is longer than the platen drum 12 so that a thermal printer can utilize the lamp middle portion which have a large intensity of radiation and high stability.

The reflector 22 is formed of material having high heat conductivity such as aluminum, at a length longer than the width of a recording area of the recording material 10. The middle portion of the long lamp 21 is covered with the reflector 22 while being in contact with the reflector 22 along the longitudinal direction of the lamp. The housing 23 is utilized for making a path of cooling air, formed of transparent or opaque material, and shaped like a channel with an opening formed in the longitudinal direction and directed to the platen drum 12. The long lamp 21 and the reflector 22 are contained in the housing 23. It is to be noted that the housing 23 may have no opening if it is made of material having high transparency for ultraviolet radiation. The fan 25 sends air into the housing 23 while the fan 26 lets the air out of the housing 23. It is also possible to utilize the fans 25 and 26 for sending air.

The outside of the reflector 22 is provided with a pair of temperature sensors 27 and 28 for measuring indirectly tube temperature of the long lamp 21. There is a space wider than the width of the recording area of the recording material 10 between the sensors 27 and 28. The sensor 27 is positioned in association with the fan 25 and the sensor 28 is positioned in association with the fan 26. A signal representing the temperature as measured by each of the sensors 27 and 28 in an analog signal is converted into a digital signal by an A/D converter 41, and then sent to a microcomputer 40 as temperature data.

The lamp unit 30 has a same construction as the above-described lamp unit 20, comprising a magenta color fixing ultraviolet lamp 31 having a longitudinal axis, a reflector 32, a channel-shaped housing 33, and a pair of cooling fans 35 and 36. The long lamp 31 has a same length as the long lamp 21 which is longer than the platen drum 12, and emanates ultraviolet radiation peaking at a wavelength of approximately 365 nm. Similarly to the reflector 22, the outside of the reflector 32 is provided with a pair of temperature sensors 37 and 38 for measuring indirectly tube temperature of the long lamp 31. A signal representing the temperature as measured by each of the sensors 37 and 38 is sent to the microcomputer 40 as temperature data through the A/D converter 41.

The microcomputer 40 is connected to a fan control circuit 42, a temperature evaluating circuit 43, a timer 44, a lamp driver 45, a print starting switch 46, and an alarm indicator 47. The fan control circuit 42 controls to drive the fans 25 and 26 according to the measured temperature by the sensors 27 and 28 to maintain the tube temperature of the long lamp 21 in a predetermined range. The fan control circuit 42 also controls to drive the fans 35 and 36 according to the measured temperature by the sensors 37 and 38.

The fans 25, 26, 35 and 36 may be controlled while being changed in their rotational speed according to the temperature gradient. However, this embodiment will be described in an ON/OFF manner, in which the fans 25, 26, 35 and 36 are driven at a constant rotational speed and stopped being driven, according to the measured temperature.

The fan control circuit 42 is constituted of a first controller 48 for controlling the fans 25 and 35 and a second controller 49 for controlling the fans 26 and 36 by comparing the temperature data of the sensors with data representing a limit reference temperature as preset. The fans 25 and 35 are driven by the controller 48 via motor drivers 51 and 53 and fan motors 55 and 57, respectively. The fans 26 and 36 are driven by the controller 49 via motor drivers 52 and 54 and fan motors 56 and 58, respectively. Note that the limit reference temperature is predetermined to be 40° C., at which the ultraviolet radiation can be obtained at the maximum intensity Lmax.

Actuation of the print starting switch 46 causes a printing command signal to be entered into the microcomputer 40, upon which the temperature evaluating circuit 43 is actuated. The temperature evaluating circuit 43 compares the temperature data from the sensors 27, 28, 37 and 38 with data representing an initial reference temperature as preset for starting the recording. If a temperature greater than the initial reference temperature is measured by both of the sensors 27 and 28 of the lamp unit 20, then the temperature evaluating circuit 43 sends a "High" signal to the microcomputer 40. If a temperature less than or equal to the initial reference temperature is measured by at least one of the sensors 27 and 28, then the temperature evaluating circuit 43 sends a "Low" signal to the microcomputer 40. The temperature evaluating circuit 43 similarly treats the temperature data as to the lamp unit 30 and sends a "High" or "Low" signal to the microcomputer 40. Note that the initial reference temperature is predetermined to be 35° C., at which the ultraviolet radiation can be obtained at the standard radiating intensity Ls, namely, the minimum sufficient for the fixation of the coloring.

The lamp driver 45 drives the lamps 21 and 31 not only during the thermal recording of the yellow and magenta images but also during an operation of standing by for recording so as to raise their tube temperature while the timer 44 measures a predetermined period of time. The alarm indicator 47 is caused by the microcomputer 40 to indicate alarming information when either of the lamps 21 or 31 is involved in an accidental operation. Note that those function of the thermal printer above are all processed within the microcomputer 40 by use of software.

Figure 4:
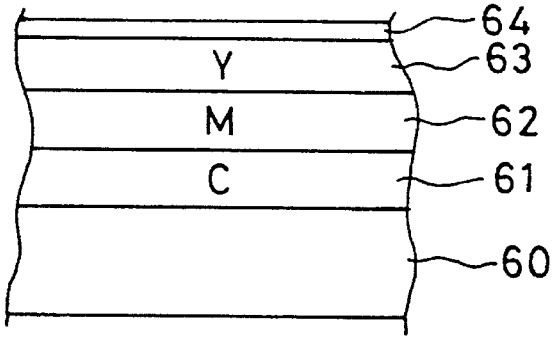
FIG. 4 is an explanatory view illustrating a layered structure of a color thermosensitive recording material.

FIG. 4 illustrates the recording material 10, in which a base sheet 60 is provided with a cyan coloring layer 61, a magenta coloring layer 62, a yellow coloring layer 63, and a protective layer 64, formed in the layered structure in the order listed. The thermal recording is performed in the order of stepped access, namely from the obverse side, the yellow coloring layer 63 toward the cyan coloring layer 61. Alternatively, recording material to be used may have a different order between layers, e.g. yellow as a middle coloring layer and magenta as the coloring layer at the obverse side. The order of the thermal recording may follow the order of magenta, yellow and then cyan. The coloring ability of the yellow coloring layer 63 is lost when ultraviolet radiation of about 420 nm is applied to the yellow coloring layer 63. The coloring ability of the magenta coloring layer 62 is lost when ultraviolet radiation of about 365 nm is applied to the magenta coloring layer 62.

The operation of the above embodiment is described now. The thermal printer is first powered. The sensors 27, 28, 37 and 38 start operating, and measure the surface temperature of the reflectors 22 and 32. Since the reflectors 22 and 32 are formed of material of high heat conductively and are in contact with the lamps 21 and 31 in the longitudinal direction of the lamps 21 and 31, the sensors 27 and 28 measure the tube temperature of the respectively facing portions of the long lamp 21 via the reflector 22, and the sensors 37 and 38 measure the tube temperature of the respectively facing portions of the long lamp 31 via the reflector 32.

Signals of the measured temperature from the sensors 27, 28, 37 and 38 are converted by the A/D converter 41 as temperature data and then sent to the fan control circuit 42 via the microcomputer 40. The temperature data of the sensors 27 and 37 is sent to the first controller 48 to be compared with the data representing the limit reference temperature 40° C. The temperature data of the sensors 28 and 38 is sent to the second controller 49 to be compared with the data representing the limit reference temperature 40° C.

In the lamp unit 20, if a temperature $T_1$ according to the temperature data by the sensor 27, that is, the tube temperature of the long lamp 21 of the portion near the fan 25 is greater than 40° C., the first controller 48 sends a drive signal to the motor driver 51 to actuate the fan 25 via the fan motor 55. If a temperature $T_2$ according to the temperature data of the sensor 28, that is, the tube temperature of the portion near the fan 26 is greater than 40° C., the second controller 49 sends a drive signal to the motor driver 53 to actuate the fan 26 via the fan motor 57. The temperature $T_1$ and the temperature $T_2$ are obtained in a combination that both of the temperatures $T_1$ and $T_2$ are greater than 40° C., the temperature $T_1$ or $T_2$ is greater than 40° C., or both of the temperatures $T_1$ and $T_2$ are less than or equal to 40° C.

If both of the temperatures $T_1$ and $T_2$ are greater than 40° C., the fans 25 and 26 are simultaneously actuated. At that time, the fan 25 sends air into the housing 23, and the fan 26 exhausts the air outside, so that cooling air streams from the fan 25 and toward the fan 26. Further, since the housing 23 is arranged between the fans 25 and 26 and covers the long lamp 21, the cooling air streams along the long lamp 21 in the axial direction so as to lower the tube temperature of the long lamp 21 overall. When the tube temperature of the long lamp 21 becomes less than or equal to 40° C., the fans 25 and 26 are stopped.

If the temperature $T_1$ or $T_2$ is greater than 40° C., the corresponding fan 25 or 26 is actuated. The actuating the fan 25 or 26 generates a stream of the cooling air around the portion at which the tube temperature is greater than 40° C., so as to cool the half portion of the long lamp 21. The tube temperature of the long lamp 21 is thus adjusted overall and uniformly because difference between the tube temperature near the fan 25 and the tube temperature near the fan 26 is reduced. When the tube temperature of the long lamp 21 becomes less than or equal to 40° C., the fan control circuit 42 sends a stop signal to the fan driver 51 or 53 to stop the fan 25 or 26.

On the other hand, if both of the temperatures $T_1$ and $T_2$ are less than or equal to 40° C., then the first and second controllers 48 and 49 send a stop signal to the motor drivers 51 and 53, respectively, so as to leave both of the fans 25 and 26 inactive.

It is to be noted that the fans 25 and 26 may be stopped when the tube temperature becomes a temperature which is lower than the limit reference temperature 40° C., e.g. 38° C., since the fan motors 55 and 57 repeat being stopped and driven at short intervals when the fans 25 and 26 are stopped with reference to 40° C.

Note that regarding the lamp unit 30 for magenta color, the tube temperature of the long lamp 31 is adjusted in a same manner as the lamp unit 20 for yellow color.

With the power supplied for the thermal printer, the print starting switch 46 is operated, performing an operation of standing by for recording. At first the microcomputer 40 actuates the temperature evaluating circuit 43. The temperature evaluating circuit 43 compares the temperature data with the data representing the initial reference temperature 35° C. If both of the temperatures $T_1$ and $T_2$ according to the temperature data of the sensors 27 and 28 are greater than or equal to 35° C., then regarding the lamp unit 20, the "High" signal is sent to the microcomputer 40. If the temperatures $T_1$ and/or $T_2$ are less than 35° C., then the "Low" signal is sent to the microcomputer 40. As to the lamp unit 30, the "High" or "Low" signal is sent to the microcomputer 40 in the same manner as the lamp unit 20. When the microcomputer 40 receives the "High" signals as to both of the lamp units 20 and 30, namely the tube temperature of both of the lamps 21 and 31 becomes 35° C., the microcomputer 40 starts the printer recording.

If "Low" signal is output from the temperature evaluating circuit 43 regarding the lamp unit 20, the microcomputer 40 actuates the timer 44 to start measurement of the predetermined period, and actuates the lamp driver 45 to turn the long lamp 21 on for pre-emitting light. The signal output from the temperature evaluating circuit 43 as "High" or "Low" is checked successively. If the output signal changes from "Low" to "High" by the pre-emission of the long lamp 21, namely the tube temperature of the long lamp 21 becomes greater than or equal to 35° C. in the predetermined period, the long lamp 21 is turned off temporarily, before starting the recording operation. If the signal output from the temperature evaluating circuit 43 remains "Low", then it is judged that the radiating intensity of the long lamp 21 is insufficient for fixation. The alarm information is indicated by the alarm indicator 47, while the microcomputer 40 inhibits the routine from starting the recording. The steps same as above are executed as to the lamp unit 30. If "Low" signal is output from the temperature evaluating circuit 43, the long lamp 31 performs pre-emission to raise its tube temperature. It is to be noted that when at least one "Low" signal is output from the temperature evaluating circuit 43, both of the lamps 21 and 31 may perform pre-emission simultaneously.

Note that the fan control circuit 42 controls to drive the fans 25, 26, 35 and 36 even while the printer is still on standby so that the tube temperature of the lamps 21 and 31, during the stand-by period, is adjusted to be between 35° C. and 40° C.

The operation of standing by for the recording causes the tube temperature of the lamps 21 and 31 to come up to 35° C. Then the recording operation is started. The recording material 10 is supplied from a cassette (not shown), and is set in a clamping position on the platen drum 12. The clamp member 11 presses the recording material 10 fixedly on the platen drum 12. Subsequently, the platen drum 12 is rotated in response to rotation of the platen motor 13, so as to wind the recording material 10 on the periphery of the platen drum 12. The recording material 10 starts being fed, at the same time as the yellow fixing lamp 21 is driven for radiation.

The platen drum 12 rotates until an advancing edge of the recording material 10 reaches the thermal head 15, which thermally records a yellow image on the yellow coloring layer 63 line after line. In the thermal recording of the yellow image, each heating element of the thermal head 15 generates heat energy determined in consideration of the coloring characteristics. A portion where the yellow image is recorded comes under the yellow fixing lamp 21 of the lamp unit 20, so as to start fixation of the yellow image. As the yellow fixing lamp 21 emanates ultraviolet radiation of approximately 420 nm, the yellow coloring layer 63 is invalidated in its coloring ability. When a trailing end of the recording material 10 is passed off from the yellow fixing lamp 21, the radiation from the yellow fixing lamp 21 is stopped.

Figure 5:
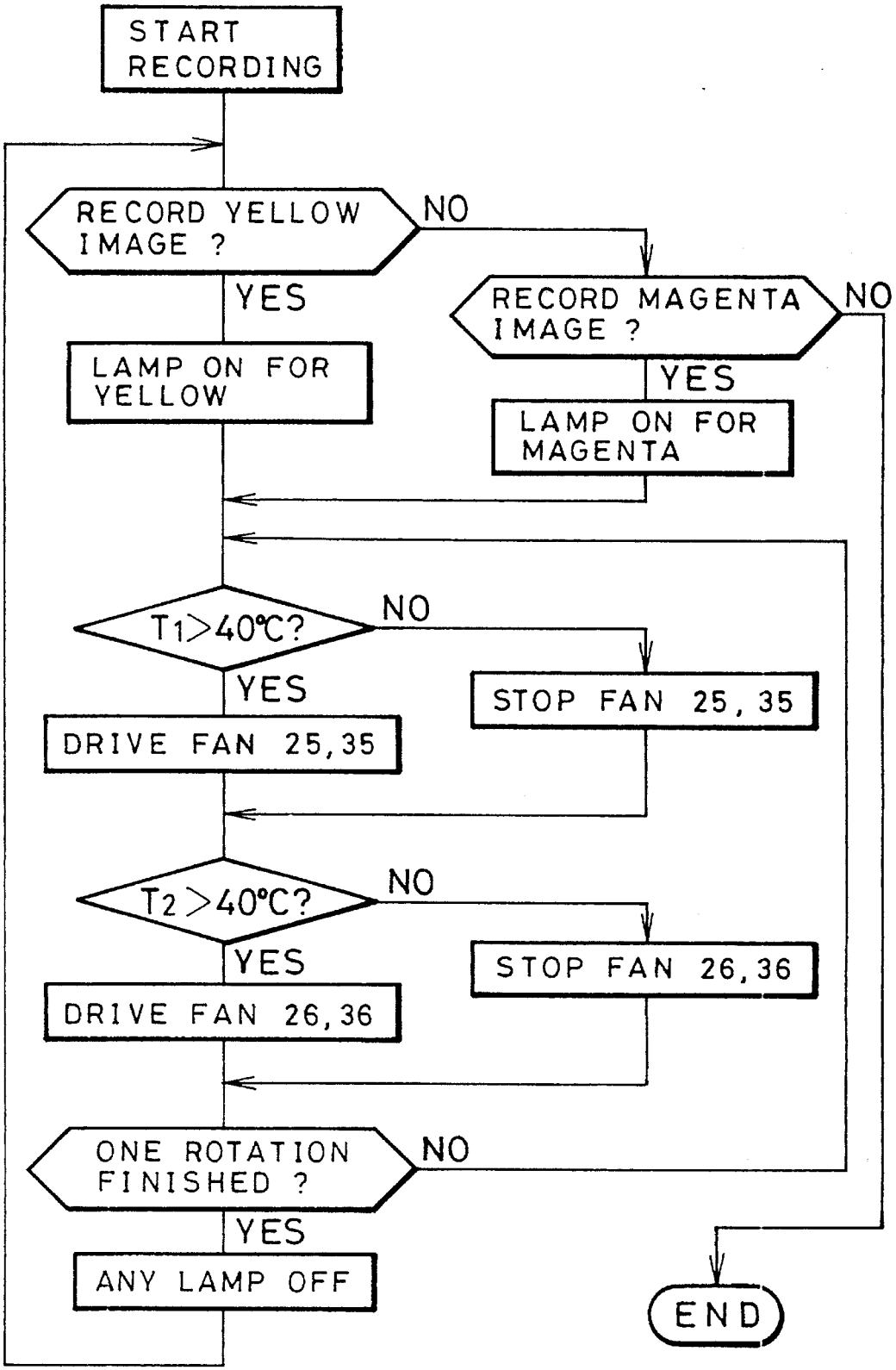
FIG. 5 is a flow chart illustrating a sequence of adjusting the tube temperature during the recording in the thermal printer.

During the fixation for the yellow coloring layer 63, the fan control circuit 42 is monitoring the lamp temperature following the flow in FIG. 5. In the flow as shown in FIG. 5, the temperature $T_1$ represents the measured temperature by the sensor 27 or 37, and the temperature $T_2$ represents the measured temperature by the sensor 28 or 38. When the tube temperature is raised by the lamp light emission, the fan control circuit 42 drives the fans 25 and/or 26 according to the temperature gradient so as to keep the tube temperature of the yellow fixing lamp 21 around 40° C. wholly in the longitudinal direction of the long lamp 21. Accordingly, the long lamp 21 emanates ultraviolet radiation sufficiently for fixation, that is, the recording material 10 is supplied with the ultraviolet radiation at standard radiating intensity Ls constantly and overall.

In the course of rotation of the platen drum 12, the advancing edge of the recording area on the recording material 10 comes to the thermal head 15 for the second time. The thermal head 15 thermally records a magenta image on the magenta coloring layer 62 line after line. In the recording of the magenta image, each heating element of the thermal head 15 generates energy determined in consideration of the characteristics. The magenta fixing lamp 31 start to emanate ultraviolet radiation of approximately 365 nm. During the fixation, the temperature of the magenta fixing lamp 31 is monitored and controlled by the fan control circuit 42 so as to keep constant intensity of ultraviolet radiation from the magenta fixing lamp 31. After the magenta image is thermally recorded on the recording material 10, the ultraviolet radiation is applied to the recording material 10 by the magenta fixing lamp 31. The magenta coloring layer 62 is invalidated in its magenta coloring ability in the entirety of the recording material 10. When the trailing end of the recording material 10 is passed off from the magenta fixing lamp 31, the radiation from the magenta fixing lamp 31 is stopped.

The platen drum 12 rotates until the advancing edge of the recording material 10 reaches the thermal head 15, which thermally records a cyan image on the cyan coloring layer 61 line after line. The coloring of the cyan coloring layer 61 requires high coloring heat energy of at least as much as 80 $mJ/mm^2$, which does not allow color to develop in an ordinary condition of preserving the recording material 10. The cyan coloring layer 61 lacks a characteristic of photochemical fixability, so that fixation is not effected during the thermal recording for the cyan coloring layer 61.

The thermal recording of the yellow, magenta and cyan images is finished. The clamp member 11 is unlatched. The recording material 10 after the thermal printing is discharged to a receptacle tray (not shown).

In the above embodiment, the lamp unit 20 for yellow color and the lamp unit 30 for magenta color are independently arranged in order to adjust the tube temperature of the yellow fixing lamp 21 and the magenta fixing lamp 31, respectively. Alternatively, the yellow fixing lamp 21 and the magenta fixing lamp 31 may be covered with a single reflector, and these lamps 21 and 31 with the reflector may be contained in a single housing. In this case, the fans of two may be disposed near the opposite sides of the lamps 21 and 31, respectively, and controlled according to measured temperature obtained from a pair of temperature sensors mounted on the reflector to be close to the fans respectively. Since the both of the lamps 21 and 31 are in contact with the reflector, the lamps 21 and 31 become to have the tube temperature almost equal to each other. This embodiment brings an advantage as the construction becomes simple.

Although one of the fans 25 and 26 is utilized for sending air into the housing 23 and the other one of the fans 25 and 26 is utilized for letting the air out of the housing 23 so as to provide air stream from one to the other one along the long lamp 21 inside the housing 23 in the above embodiment, the both fans may be utilized for sending air toward the opposite ends of the long lamp 21. At that time, the air absorbing heat from the long lamp 21 escapes from the housing 23 through the opening of the channel-shape. Further, it is possible to utilize the both fans for letting out air, wherein the air inside the housing 23 heated by the long lamp 21 is let out of the housing 23 from the opposite sides thereof, so as to lower the tube temperature of the long lamp 21. Of course, it is also possible to utilize the both fans 35 and 36 for letting air in or out.

The fans 25 and 26 may be controlled in their rotational speed according to the temperature gradient of the long lamp 21 in the longitudinal direction. The fans 35 and 36 may also be controlled in their rotational speed according to the temperature gradient of the long lamp 31 in the longitudinal direction. The rotational speeds of the respective fans 25, 26, 35 and 36 may be determined according to the difference between the measured temperature of the respective sensors 27, 28, 37 and 38 and the limit reference temperature. That is, when the measured temperature is greater than the reference temperature and the difference is small, the corresponding one or ones of the fans are driven at a low speed. On the other hand, when the difference is large, the corresponding one or ones of the fans are driven at a high speed. Accordingly, the tube temperature is lowered overall quickly.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A lamp temperature control device for a lamp having a longitudinal axis for emanating electromagnetic radiation comprising:

a reflector disposed behind said lamp for reflecting to a forward direction electromagnetic radiation emanated in a rearward direction from said lamp;

first and second cooling fans arranged face to face with opposite ends of said lamp;

a first temperature sensor mounted on said reflector for indirectly measuring a first temperature of a portion of said lamp near said first fan;

a second temperature sensor mounted on said reflector for indirectly measuring a second temperature of a portion of said lamp near said second fan; and fan control means for controlling said first and second fans according to said first and second temperatures so as to keep temperature of said lamp overall and uniformly in a predetermined range.

2. A lamp temperature control device as recited in claim 1, wherein said reflector is in contact with said lamp along a longitudinal direction of said lamp to receive a heat energy from said lamp.

3. A lamp temperature control device as recited in claim 2, further comprising a cylindrical housing for containing said lamp and said reflector, and said first and second fans being mounted on opposite ends of said housing.

4. A lamp temperature control device as recited in claim 3, wherein said housing is provided with an opening formed in a front side of said housing in the longitudinal direction.

5. A lamp temperature control device as recited in claim 4, wherein one of said first and second fans is utilized for sending air into said housing and the other one of said first and second fans is utilized for letting air out of said housing so as to generate a stream of air from the one to the other one along said lamp.

6. A lamp temperature control device as recited in claim 3, wherein said fan control means rotates said first fan when said first temperature is greater than a reference temperature, and rotates said second fan when said second temperature is greater than said reference temperature.

7. A lamp temperature control device as recited in claim 3, wherein said fan control means rotates said first fan with speed according to difference between said first temperature and said reference temperature when said first temperature is greater than said reference temperature, and rotates said second fan with speed according to difference between said second temperature and said reference temperature when said second temperature is greater than said reference temperature.

8. A lamp temperature control device for a lamp having a longitudinal axis for emanating electromagnetic radiation, comprising:

a reflector disposed behind said lamp for reflecting to a forward direction electromagnetic radiation emanated in a rearward direction;

a cylindrical housing for containing said lamp and said reflector while keeping said electromagnetic radiation of said lamp from being blocked;

first and second cooling fans mounted on opposite ends of said cylindrical housing;

a first temperature sensor fixed on said reflector for indirectly measuring temperature of a portion of said lamp near said first fan;

a second temperature sensor fixed on said reflector for indirectly measuring temperature of a portion of said lamp near said second fan; and fan control means for driving and stopping said first and second fans; wherein said first fan is driven when a temperature measured by said first sensor is greater than a first reference temperature and is stopped when said temperature measured by said first sensor decreases to a second reference temperature which is lower than said first reference temperature, and said second fan is driven when a temperature measured by said second sensor is greater than said first reference temperature and is stopped when said temperature measured by said second sensor decreases to said second reference temperature.

9. A color direct thermal printer for printing a full color image on color thermosensitive recording material having first, second and third thermosensitive coloring layers which are colored selectively in accordance with heat energy applied by a thermal head, said first, second and third coloring layers being developed in a different color, and are formed in listed order from an obverse side toward a reverse side, said color direct thermal printer comprising:

a first ultraviolet lamp having a longitudinal axis for emanating a first ultraviolet radiation so as to fix said first coloring layer with said first ultraviolet radiation, in a course of movement of said recording material in a first direction perpendicular to said longitudinal axis of said first lamp, after said thermal head thermally records on said first coloring layer;

a second ultraviolet lamp having a longitudinal axis arranged in parallel with said longitudinal axis of said first lamp, for emanating a second ultraviolet radiation in a wavelength range different from said first ultraviolet radiation so as to fix said second coloring layer with said second ultraviolet radiation, in a course of movement of said recording material in said first direction, after said thermal head thermally records on said second coloring layer;

at least one reflector disposed behind said first and second lamps for reflecting to a forward direction ultraviolet radiation emanated to a rearward direction of said first and second ultraviolet radiations, there being portions of said reflector contacting said first and second lamps along a longitudinal direction of said first and second lamps to receive heat from said first and second lamps;

at least one cylindrical housing for containing said first and second lamps and said reflector;

at least one pair of fans mounted on opposite ends of said housing for cooling said first and second lamps;

at least one pair of temperature sensors mounted on both ends of said reflector for indirectly measuring temperature of tubes of said first and second lamps;

fan control means for controlling said fans according to temperature measured by said temperature sensors to cool said first and second lamps overall so as to lower said tube temperature of said first and second lamps to a first reference temperature when said tube temperature of said first and second lamps is greater than said first reference temperature; and lamp heating means for pre-emission of at least one of said first and second lamps for a predetermined period before printing so as to raise said tube temperature of said first and second lamps when a measured temperature is less than a second reference temperature which is lower than said first reference temperature.

10. A color direct thermal printer as recited in claim 9, wherein said at least one pair of fans comprise first and second fans, said at least one pair of sensors comprise first and second sensors positioned to be close to said first and second fans, respectively, and said fan control means rotates said first fan with speed according to difference between a temperature measured by said first sensor and said first reference temperature when said temperature measured by said first sensor is greater than said first reference temperature, and rotates said second fan with speed according to difference between a temperature measured by said second sensor and said first reference temperature when said temperature measured by said second temperature is greater than said first reference temperature.

11. A color direct thermal printer as recited in claim 9, wherein said at least one pair of fans comprise first and second fans, said at least one pair of sensors comprise first and second sensors positioned to be close to said first and second fans, respectively, and said fan control means rotates said first fan when a temperature measured by said first sensor is greater than said first reference temperature, and rotates said second fan when a temperature measured by said second sensor is greater than said first reference temperature.

12. A color direct thermal printer as recited in claim 9, wherein said first and second lamps each have a length which is longer than a width of said recording material, and said reflector has a length which is enough to cover said recording material in width thereof.

13. A color direct thermal printer as recited in claim 9, wherein said at least one reflector comprises first and second reflectors;

said at least one housing comprises first and second housings, said first housing contains said first lamp and said first reflector and said second housing contains said second lamp and said second reflector;

said at least one pair of fans comprise first, second, third, and fourth fans, said first and second fans are mounted on opposite ends of said first housing and said third and fourth fans are mounted on opposite ends of said second housing; and said at least one pair of sensors comprise first, second, third, and fourth sensors, said first sensor is mounted near said first fan, said second sensor is mounted near said second fan, said third sensor is mounted near said third fan, and said fourth sensor is mounted near said fourth fan.

14. A color direct thermal printer as recited in claim 13, wherein said first, second, third, and fourth sensors correspond to said first, second, third, and fourth fans, respectively, when a temperature measured by any sensor of said first, second, third, and fourth sensors is greater than said first reference temperature, corresponding one of said first, second, third, and fourth fans is rotated with speed according to difference between said temperature measured by said any sensor and said first reference temperature.

15. A color direct thermal printer as recited in claim 13, wherein said first, second, third, and fourth sensors correspond to said first, second, third, and fourth fans, respectively, when a temperature measured by any sensor of said first, second, third, and fourth sensors is greater than said first reference temperature, corresponding one of said first, second, third, and fourth fans is rotated.

* * * * *